United States Patent [19]

Hüsler

[11] Patent Number: 4,827,544

[45] Date of Patent: May 9, 1989

[54] RECLINING AND LYING MEANS, PARTICULARLY FOR A BED

[75] Inventor: Balthasar Hüsler, Oensingen, Switzerland

[73] Assignee: Hüsler-Liforma Entwicklungs AG, Zug, Switzerland

[21] Appl. No.: 72,058

[22] PCT Filed: Oct. 16, 1986

[86] PCT No.: PCT/CH86/00145

§ 371 Date: Jun. 5, 1987

§ 102(e) Date: Jun. 5, 1987

[87] PCT Pub. No.: WO87/02559

PCT Pub. Date: May 7, 1987

[30] Foreign Application Priority Data

Oct. 22, 1985 [CH] Switzerland ..... 4532/85
Oct. 1, 1986 [CH] Switzerland ..... 3929/86

[51] Int. Cl.[4] ..... A47C 17/00; A47C 23/06

[52] U.S. Cl. ..... 5/236 B; 5/241; 5/191

[58] Field of Search ..... 5/236, 237, 239, 241, 5/245, 446, 447, 455, 191

[56] References Cited

U.S. PATENT DOCUMENTS

| | | | |
|---|---|---|---|
| 2,225,858 | 12/1940 | Church | 5/239 |
| 2,638,606 | 5/1953 | Austin | 5/239 |
| 3,067,438 | 12/1962 | Degen | 5/236 |
| 4,477,935 | 10/1984 | Griffin | 5/241 |
| 4,559,656 | 12/1985 | Foster | 5/236 |
| 4,644,596 | 2/1987 | Hüsler | 5/236 |

FOREIGN PATENT DOCUMENTS

| | | | |
|---|---|---|---|
| 0116237 | 8/1984 | European Pat. Off. . | |
| 2621803 | 6/1977 | Fed. Rep. of Germany | 5/236 |
| 2832584 | 2/1980 | Fed. Rep. of Germany | 5/236 |
| 3230494 | 2/1984 | Fed. Rep. of Germany | 5/236 |
| 3232123 A1 | 3/1984 | Fed. Rep. of Germany . | |
| 1206497 | 2/1960 | France | 5/236 |
| 2442031 | 7/1980 | France | 5/236 |
| 620581 | 12/1980 | Switzerland | 5/236 |

*Primary Examiner*—Alexander Grosz
*Assistant Examiner*—Eric K. Nicholson
*Attorney, Agent, or Firm*—Walter C. Farley

[57] ABSTRACT

A structure for supporting a reclining and lying means comprises a lath grating (14) formed from a plurality of transverse laths (13) which is arranged on a support structure (10,20) having at least two longitudinally oriented, spaced longitudinal beams (spring bodies) (12, 12'; 22, 22') acting resiliently at right angles to their loading and which are assembled into a structural unit with approximately regularly arranged spring elements (13) and lath grating (14) operatively connected by a cover which holds the components together.

11 Claims, 4 Drawing Sheets

RECLINING AND LYING MEANS, PARTICULARLY FOR A BED

The invention relates to a reclining and lying means with a grating-like arrangement of a plurality of transverse laths, slats or battens arranged on a common support or substrate structure.

BACKGROUND OF THE INVENTION

The progressive constructional development of such reclining and lying means is essentially based on the criteria given hereinafter:

a. from the orthopaedic standpoint the complete lying surface is to be constructed in such a way that, as a function of the weight, size and lying characteristics (reclining position) the body of the user is supported in an optimum manner and can rest in a relaxed state;

b. from the hygiene standpoint, the moisture given off by the user is adequately led away and breathing characteristics (ventilation) are ensured; and c. from the handling standpoint, an optimum lightweight, easy design is sought, whilst retaining the lying and reclining qualities.

The state of the art in connection with lath grating beds is directed at flexibly supporting resilient transverse laths, the individual lath forming the main spring element. The lath considered to be the main spring element generally has complicated multilayer gluing, in order to bring about the so-called camber. This camber ensures that under load, the individual spring laths are straightened and consequently the lying surface is "flat". This loading-dependent lying "plane" is matched to the load exerted by an average human being (generally with a height of 170 cm and a weight of 70 kg). This suffers from one of many disadvantages that a person weighing less, e.g. 50 kg and resting on the camber has less sleeping comfort, as does a heavier person, e.g. weighing 90 kg who lies on laths which have sunk down or sagged. Thus, in these circumstances, there is an uncontrolled springiness, on the basis of the overall spring action. The interaction with a sufficiently thick mattress reduces this discomfort, but in principle the fundamental defficiency remains.

Moreover, known lath grating beds are still relatively solid, heavy constructions with a plurality of individual elements, such as lath position stabilizers, which are generally centrally located, terminal flexible elements and their fixing to the lath and frame (it being impossible without the frame) together with the further refinenents based on additional or special laths, generally in special colours. Thus, to achieve a satisfactory individual spring action, considerable effort and expenditure are required, whilst still not always achieving the sought objective.

An object of the present invention is to provide and further develop a reclining and lying means of the aforementioned type, so that it is possible to satisfy the aforementioned requirements (criteria a,b,c), whilst ensuring a controllable spring action in a simple and economic manner.

According to the invention this problem is solved in that the springiness function of the lath elements arranged in grating-like manner is transfered to support elements (spring bodies) acting resiliently at right angles to their load and on which they are supported. Preferably the approximately regularly arranged lying laths with a covering structure (fabric structure) and the resiliently acting support elements form a constructional unit. The support elements (spring bodies) are preferably easily interchangeable, for controlling the spring strength, deflector, etc.

As a result of the lying surface according to the invention, it is possible to ensure a uniform springiness adaptable to the different human body weights and sizes over the entire surface, i.e. the lying plane functions together with the human body, independently of the mattress. The resilience or springiness is essentially defined by the elasticity of the support elements (spring bodies) running longitudinally and not by the lath elements in their grating-like arrangement and is preferably adapted by the spring bodies to the user's weight. In the case of misadaptation, the lying surface still remains flat and is merely considered to be too hard or soft.

BRIEF DESCRIPTION OF THE DRAWINGS

Embodiments of the invention are described in greater detail hereinafter relative to the drawings, wherein.

DESCRIPTION OF THE PREFERRED EMBODIMENT

Figure 1:
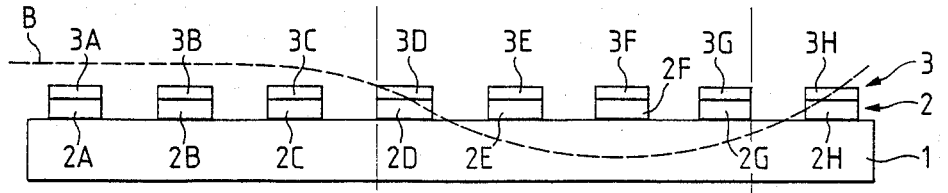
FIG. 1 PRIOR ART
FIGS. 1 and 2A are schematic diagrams in side view of an unloaded and a loaded lying surface according to the invention.
Figure 1A:
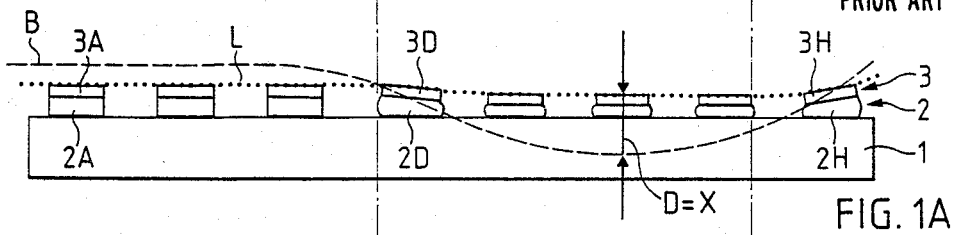
FIG. 1A PRIOR ART
FIGS. 2 and 1A are schematic diagrams in side view of an unloaded and a loaded lying surface according to the prior art.
Figure 2:
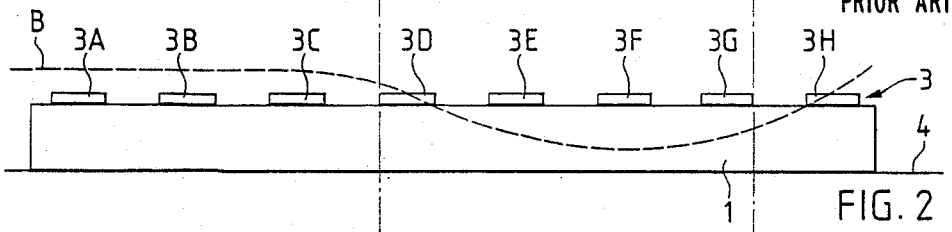
Figure 2A:
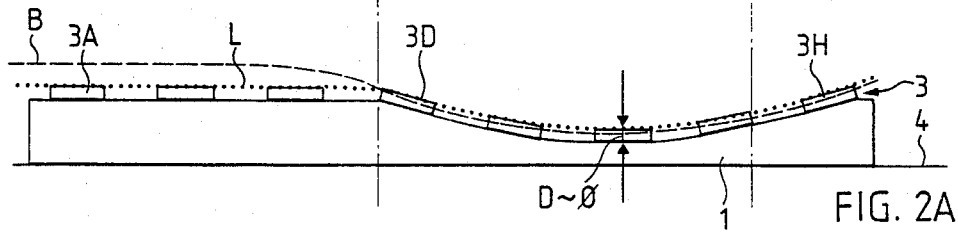

FIGS. 1, 1A and 2A show in stylized form a functional example of a lath grating lying surface according to the prior art compared with such a surface according to the invention. They show the fundamental differences in the spring dynamics occuring as a result of the invention on the one hand and the prior art on the other.

Both the stylized lath grating lying surfaces of FIGS. 1, 1A and 2, 2A have as basic components a longitudinal beam 1 which, in the prior art can also be a rigid bedframe between which the laths are fixed, as well as transverse laths connected to the longitudinal beam. An assumed loading curve B is superimposed on both the constructions and both react in their characteristic manner with a loading profile or lying curve L.

FIG. 1 shows the lying surface with a rigid longitudinal beam 1, a lath spring system with spring elements identified as 2A–2H and with laths 3 identified as 3A–3H, which have their standard spring function in the longitudinal direction. The broken line assumes that loading curve B is chosen in such a way that the construction is strongly loaded in its elastic adaptation. FIG. 1A shows the reaction to this loading case. Laths 3A, 3B and 3C are uniformly slightly loaded and spring elements 2A, 2B and 2C scarcely reveal any deformation. Lath 3D is loaded in sloping manner and spring element 2D is deformed on one side. In the case of laths 3E, 3F and 3G, the spring elements are forced through up to the stop member such that the resulting lying curve L is distorted with respect to the loading curve in the vicinity of the spring elements. In the vicinity of lath 3F, where the maximum spring travel should occur, there is a springiness deficit D of magnitude X. This springiness deficit D is uncontrollably absorbed by the spring action of the now bent transverse laths. However, orthopaedic teaching states that an underbed, even in the case of very considerable loading, must not "sag" longitudinally in the centre of the transverse laths, so that the vertebral column is correctly supported. Thus, known lying surfaces have limits with respect to the spring deflection of the transverse laths (spring deflection limitation, adjustable spring strengths, etc.). It is clear that without additional and in part complicated special measures, from the orthopaedic standpoint such constructions are overstressed or overloaded. Thus, the missing lying comfort is not infrequently brought about by means of the mattress, which means that the bed structure does not fulfill its function and from the hygienic standpoint brings about a deterioration of the characteristics of the bed. This means that at least in this area the spring elements are no longer able to fulfill the springiness function and the construction is overloaded.

However, the situation is quite different in the case of the inventive lying surface of FIG. 2. The primary elements are supported on a fixed (non-resilient) substrate 4 or on the floor. These are elastic longitudinal beams 1 (spring bodies) with lying laths 3 supported thereon and which are generally straight, i.e. have no functional bending and in whose longitudinal direction they do not have to exert any special spring function when loaded. Thus, the complete spring or springiness function is transferred to the elastic longitudinal beams (spring bodies). The same loading curve B as shown in FIG. 1A is also shown here in superimposed form. The effect of this loading case is shown in FIG. 2A. Over the entire bed width, lying curve L coincides with loading curve B, so that there is no distortion in the outer or marginal region and there is no significant springiness deficit D. Thus, the inventive construction is able to provide better adaptation to an anatomical loading profile. The aforementioned orthopaedic teaching is satisfied, in that the elasticity of the longitudinal beams (spring bodies) is chosen as a function of the user's weight. If use is made of an excessively soft material, there can still be no longitudinal sag, because the spring travel is limited by the fixed substrate 4, which does not sag. If an excessively hard or rigid material is used, the user still does not lie on a camber, because no pretensioned transverse laths are used. The lying surface is merely considered to be somewhat too hard. This can be easily adapted in subsequently described embodiments.

In the longitudinal direction, the anatomical loading profile has a much greater significance than in the transverse direction. Although hitherto the greatest efforts have been made to make lath grating beds more advantageous from the lying standpoint in the transverse direction than in the longitudinal direction, this was due to the general development of such beds. The first efforts were directed at a resilient action of the then rigid laths, which could only at a later date be flexibly fixed. Since then there has been no fundamental change, despite constant efforts to obtain maximum spring comfort in the longitudinal direction.

The lying surface construction according to the inventive idea permits very lightweight and also simple embodiments. As can be gathered from the further drawings, such lying surfaces can be placed directly on the floor or in a conventional bed frame. This permits many different uses, e.g. as a camping bed, emergency couch, normal bed, wall bed, etc. without any loss of the lying comfort, which is very considerable in the price range of a camping bed. If it is borne in mind that all the aforementioned applications have hitherto required their own special designs and were subject to enormous quality differences, the lying substrate reducing these to a common denominator represents a very progressive idea.

Figure 3:
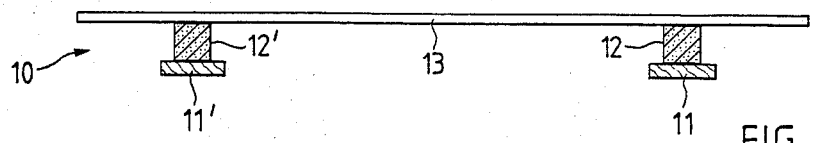
FIG. 3 is a side elevation in section, of a support or substrate structure for a reclining and lying means in accordance with the invention.
Figure 4:
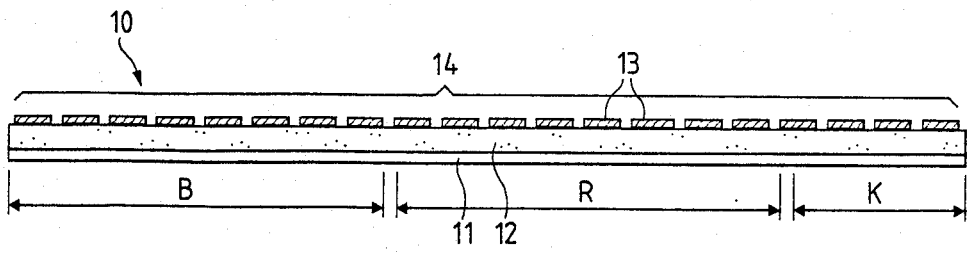
FIG. 4 is a side elevation of a support structure according to FIG. 3.

FIG. 3 is a transverse sectional view and FIG. 4 a side view of the essential parts of a support or substrate structure 10.

Support structure 10 comprises at least two parallel-spaced longitudinal beams (spring bodies) 12, 12' (or 1 according to FIG. 2, 2A) running in the longitudinal direction of the support structure and on which are arranged a plurality of transverse laths 13 substantially oriented at right angles thereto. The individual, spaced transverse laths form a lath grating 14. The fixed, non-resilient substrate 4 according to FIG. 2, 2A is referred to as support beam 11, 11'.

Figure 5:
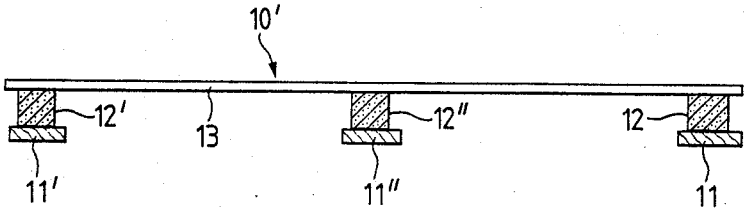
FIG. 5 is a second embodiment of the support structure shown in sectional view.

The support structure 10' shown in FIG. 5 essentially corresponds to the support structure 10 described hereinbefore relative to FIGS. 3 and 4. Unlike in the former cases, in the present embodiment there are three spaced longitudinal beams (spring bodies) 12, 12', 12'', e.g. for a double bed or when using softer material for the longitudinal beams 12 (spring bodies).

In the case of approximately regularly spaced transverse laths 13 are operatively connected with the longitudinal beams (spring bodies) 12, 12', 12'' in a not shown manner and together therewith essentially form a constructional unit resting on carriers 11, 11', 11'', corresponding to the longitudinal beams (spring bodies) 12, 12', 12'', of a not shown bed frame or on the floor.

Figure 6:
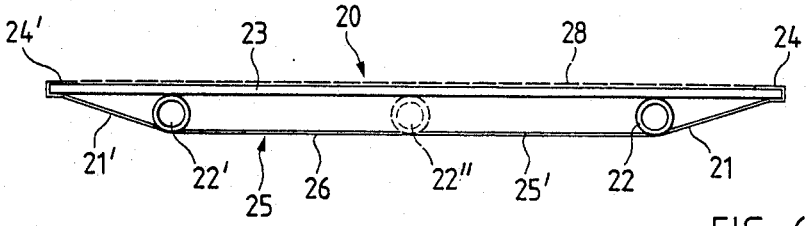
FIG. 6 is a third embodiment of a support structure.

FIG. 6 shows a support structure 20, which has two or more integrated, spaced longitudinal beams (spring bodies) 22, 22', 22'', a plurality of transverse laths 23 and a foil-like underlayer 25. The latter essentially comprises a central part 25' interconnecting the members 22, 22' and two side parts 21, 21'. In the outer region of underlayer 25, side parts 21, 21' are provided with spaced pockets 24, 24' in the longitudinal direction of support structure 20 which are constructed to receive transverse laths 23. On the other side facing underlayer 25, it is possible to provide an overlayer 28 (dotted line) which is also in foil-like forn and covers the transverse laths 23. In the vicinity of pockets 24, 24', overlayer 28 is connected to underlayer 25 by a not shown fastener or zipper running over the entire length of the support structure 20.

It is pointed out here that in use, in connection with the support structure 10 according to FIG. 4, on the lath grating 14 can be loosely placed a lightweight overmattress, preferably in the form of a not shown futon. Through the loose application of a futon or the like, it is possible to ensure above-average ventilation of the hygienically stressed material, without involving additional expenditure. Such a futon is generally much less expensive than a conventional mattress.

Figure 6A:
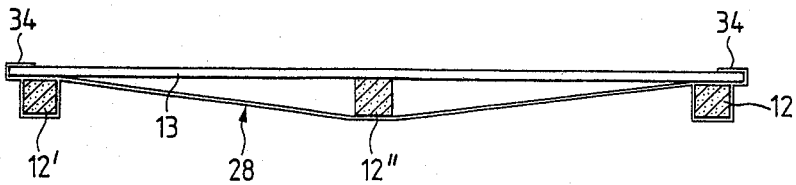
FIG. 6A is a fourth embodiment of a support structure.

FIG. 6A shows a modified embodiment based on FIG. 5, in which the overlayer 28 is merely stretched over a centrally running, resiliently acting longitudinal beam (spring body) 12'', whereas the two outer lateral, resiliently acting longitudinal beams (spring bodies) 12, 12' are not covered. These outer longitudinal beams are e.g. inserted in tunnelways, in such a way that if needed can be replaced easily without requiring any special aids. Corresponding details are provided in connection with FIG. 9.

Figure 7:
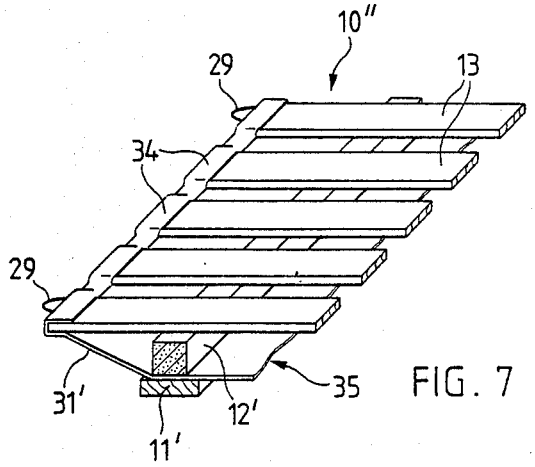
FIG. 7 is a portion of the support structure according to FIG. 3 shown in perspective plan view.

FIG. 7 shows a portion of a support structure 10'' in perspective plan view. This support structure 10'' essentially corresponds to parts 11', 12', 13 of support structure 10, 10' of FIGS. 3, 4 and 5. Diverging therefrom, in this embodiment there is a foil-like underlayer 35, which is laterally provided with spaced pockets. The portion shown in FIG. 7 shows one side of the support structure 10'' and it is possible to see the side part 31' with pockets 34, in which the transverse laths 13 are inserted and positively secured. In the vicinity of the support surface on carrier 11', the foillike underlayer 35 is preferably reinforced.

Figure 8:
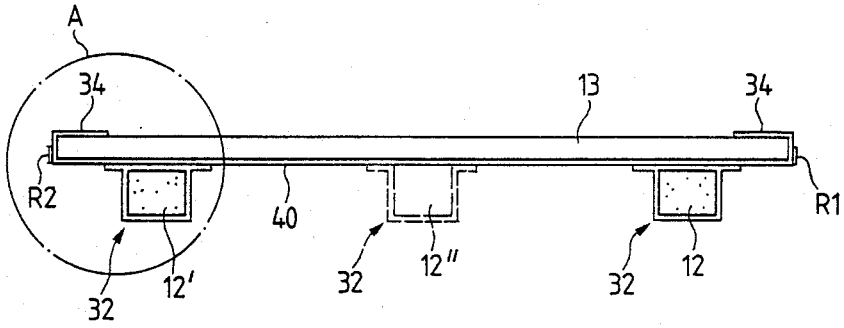
FIG. 8 is a fifth embodiment of a support structure according to FIGS. 3 and 5 in a modification of the embodiment of FIG. 6.

FIG. 8 shows as a further embodiment a covering type, which differs from that shown in FIGS. 6 and 7 and extends beyond that of FIG. 6A. The support structure is formed by several, preferably two or three, integrated, spaced longitudinal beams (spring bodies) 12, 12', 12'', a plurality of transverse laths 13 and a covering 40. The covering with the aforementioned pockets 24, 34 runs completely along the transverse laths 13. The longitudinally directed carrier elements 12, 12', 12'' are inserted in tunnelways 32 sewn onto the covering and relative to which details will be given in conjunction with FIG. 9. Covering 40 is relatively snug fitting in the transverse lath direction, so that in any loading case the laths remain in their associated pockets (FIGS. 6, 7 and 8). Normally there is no sagging of the transverse laths 13. The laths are preferably made from unglued solid wood, have a thickness of 8–12 mm, have no camber and are therefore easy to manufacture. However, in the case of an extreme concentrated load these laths do bend or bow, e.g. when standing or jumping on such a support structure. It may occur in such a case that a transverse lath will slip out of its pocket, but it can easily be returned into place by e.g. using a shoehorn.

Hereinafter a description is given of special developments and characteristics of the individual elements of the support structures 10, 10', 10'' and 20. The longitudinal beams (spring bodies) 1, 12, 12', 12'' and 22, 22' shown in the drawings are basically constructed as resiliently acting shaped or moulded parts.

The longitudinal beams (spring bodies) 12, 12', 12'' shown in FIGS. 3–6 have a full profile cross-section and are made from an elastic material, e.g. latex foam, foan rubber, foams or the like with a polygonal, parallelepipedic, circular or elliptical shape. In the case of beds for children, it is recommended that a square crosssection of 50–70 mm should be used, whereas in the case of beds for adults this should be 70–100 mm, in order to ensure the full, neccessary spring travel. Preference is given to the use of soft materials, particularly flexible foamed latex, so that through the weight of the bed substrate, the longitudinal beams readily adapt to a given contour of the rigid substrate 4, 11.

The longitudinal beams (spring bodies) 22, 22' shown in FIG. 6 are constructed as hose or tube-like hollow bodies and can have a parallelepipedic, circular or elliptical profile cross-section. These longitudinal beams are constructed as inflatable hollow bodies, to which are welded or on which are shaped the side parts 21, 21' as well as the central part 25' of underlayer 25.

The individual, lath-like transverse laths 13 together form the lath grating 14. The individual transverse lath 13 is preferably made from unglued solid wood. Further materials can be layer-glued plywood, appropriately shaped plastic, extruded profiles or relatively thin steel sheeting or the like.

For all embodiments, the distance between the individual transverse laths 13 is preferably approximately 10–20 mm, so that it is possible to ensure an adequate supporting and springiness of the body resting on the substrate or support structure, together with an optimum exclusion of moisture (ventilation). The transverse laths 13 preferably have the following dimensions: thickness 8–12 mm, width 20–45 mm and length 70–120 mm. The projection length over the longitudinal beams (central axis) is preferably 10–15%.

In the represented embodiments, the individual transverse laths 13 are inserted in the spaced pockets 34 and are consequently fixed in position (cf. FIG. 7). The transverse laths 13 inserted in pockets 24, 24', 34' can be removed, turned or replaced with respect to the pockets without requiring any special aids.

In the embodiments shown in FIGS. 3, 4 and 5, the individual transverse laths 13 can be placed on the longitudinal beams (spring bodies) 12, 12', 12'' and held together by not shown means, e.g. by a not shown belt (loop) or the like or can be operatively connected by adhesion with the said longitudinal beams. In a not shown embodiment, corresponding, spaced recesses can be provided for fixing the position of the transverse laths 13 in the longitudinal beams (spring bodies) 12, 12', 12''.

The construction according to FIG. 6 is to serve as a camping bed, emergency couch, mass bed, etc. and is placed directly on the ground. Support structure 20 has inflatable longitudinal beams (spring bodies) 22, 22', which form a unit with underlayer 25 or flexible longitudinal beams (spring bodies) 12, together with covering 40 (see FIG. 9). The necessary pretensioning of underlayer 25 is produced by the transverse laths 13 inserted in pockets 24, 24'. Underlayer 25 or covering 40 can be made from a fabric or cloth, which is provided on support surface 26, preferably with a decorative, not shown pattern, so that when such lightweight lying supports are not in use they can e.g. serve as a decorative wall and can be detachably fixed by means of rings. By means of said rings, the lightweight bed structure can also be hung on a wardrobe-like frame, together with the lightweight, thin, mattress-like futon.

The support structures 10, 10' and 20 can be used either as an individual bed or as a mass couch and held together by means of rings 29 or zippers R1/R2. A further advantage is that the support structure 20 with the inflatable longitudinal beams (spring bodies) 22, 22' according to FIG. 6 in the uninflated state can be longitudinally rolled up or, in the embodiment according to FIG. 10 folded together and then kept in this way by means of zippers R1/R2, so than an easily transportable, compact unit is formed. The latter can be used as a pocket.

As shown in FIG. 4, the support structure 10, 10', 10'' and 20 can be subdivided into individual different hardness zones K, R and B extending over the entire length, K being the head part, R the body part and B the leg part. In a not shown embodiment a head support is e.g. provided in the head part K. For demanding orthopaedic adaptations (cf. FIG. 11), the hard, non-resilient substrate 4, 11 is brought into the desired, anatomically necessary form (lying profile) by means of profiled, but rigid intermediate bodies 4' between longitudinal beams 1, 12 and substrate 4, 11. Due to the "softness" of the longitudinal beams (spring bodies), the lying substrate follows the desired shape predetermined by the intermediate bodies 4' (lying profile). This type of flexibility is a characteristic of the lying substrate according to the invention, which adapts to a predetermined profile as a result of its own shape. For orthopaedic purposes, this permits all possible profiling forms. For normal use, the lying substrate is either placed on a planar, rigid substrate 4 or on rigid support members 11, 11', e.g. in a bed frame.

Thus, the invention essentially relates to a support structure 10 or 20 with at least two longitudinally oriented, spaced longitudinal beams (spring bodies) 12, 12' or 22, 22', which act resiliently at right angles to their loading and which are constructed as a constructional unit with the approximately regularly arranged and therefore operatively connected transverse laths 13 of lath grating 14. A cloth structure is preferably used for forming the constructional unit.

Figure 9:
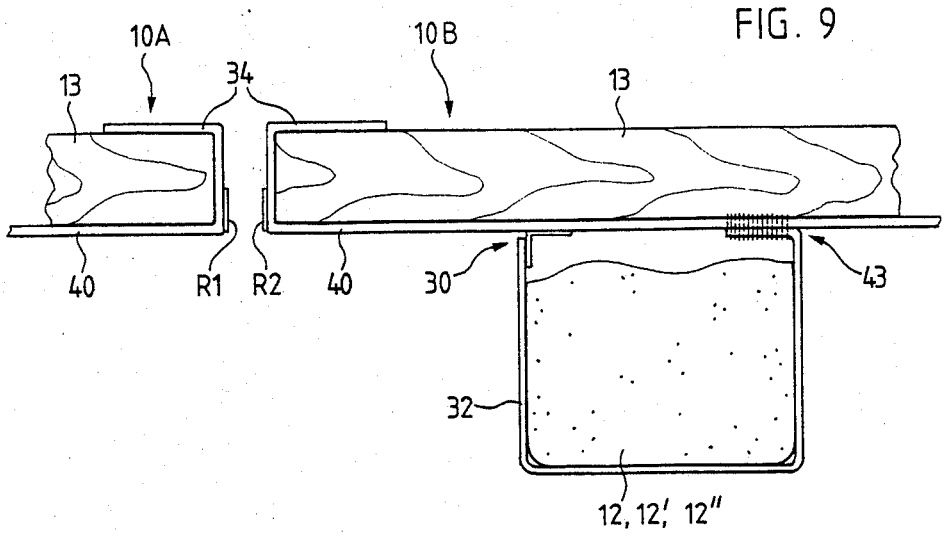
FIG. 9 is a portion of the support structure according to FIG. 11.

FIG. 9 shows a detail as to how the elastic longitudinal beams (spring bodies) 12, 12', 12'' can be inserted in easily interchangeable manner into tunnelways 32. Tunnelway 32 is sewn onto e.g. covering 25, 40 by means of sewing points 43, either as shown in FIG. 8, or as shown in FIGS. 6 and 6A. On the longitudinal side, tunnelway 32 has a closure 30, which can be in the form of a zipper, burr closure etc. The tunnelway is then opened in such a way that the elastic carrier elements 12 can be easily removed from the tunnelway and then reinserted therein. This is e.g. very useful, if it is necessary to replace or interchange these elements due to wear, or due to adaptation to a different user weight, for cleaning, etc. In addition, this solution also contributes to rational manufacture. This drawing also shows an embodiment in conjunction with two lying means lOA, lOB, both bed parts are provided lengthwise with a zipper R1 or R2, which can be interconnected. Thus, several couchs can be joined into a larger couch or mass bed by such a zipper connection R1/R2.

Figure 10:
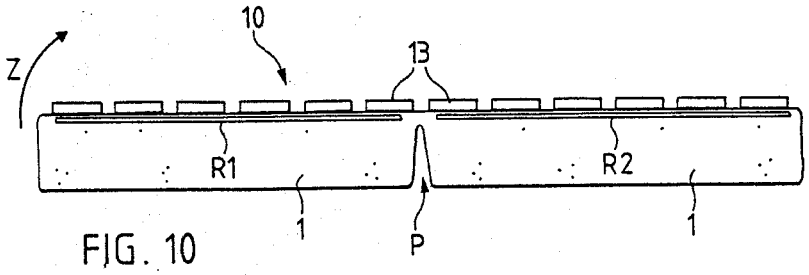
FIG. 10 is a sixth embodiment of a support structure with a partitioned spring element in the longitudinal direction.

FIG. 10 shows an embodiment with subdivided, i.e. partitioned longitudinal beams 1. Groove P is made centrally in the longitudinal beams and makes it possible to fold or flap the lying surface. The couch can be folded up in the direction of arrow Z in small space form by means of two grooves P. The folded couchs or beds can generally be stacked in a small space and are therefore advantageous when little space is available.

Figure 11:
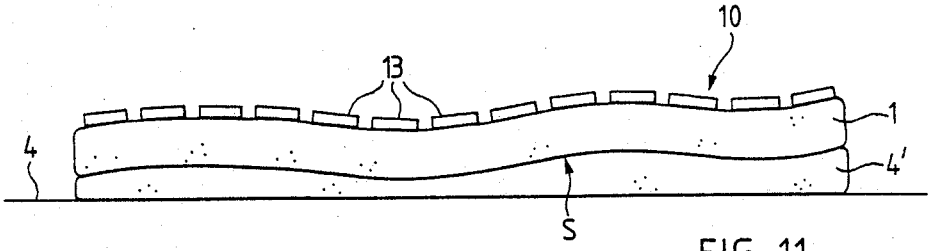
FIG. 11 is a seventh embodiment of a support structure with a profiled intermediate layer, e.g. for orthopaedic purposes.

Finally, FIG. 11 shows the unloaded lying support 10 on a rigid intermediate layer 4' with an e.g. orthopaedically conditioned profile S and which is in turn placed on a conventional substrate 4, 11, 11'. Such intermediate layers may only extend over part of the total length of the lying support. Further characteristics in connection with FIG. 11 have already been mentioned in the discussion of FIG. 4.

Despite the great versatility of this lightweight, easily handlable structure, it is in all cases a full bed with full lying comfort. None of the embodiments constitutes a functionally "frugal" solution, such as is generally the case with simplified constructions.

I claim:

1. A structure for supporting a reclining human body comprising a plurality of elongated, substantially parallel, spaced apart longitudinally extending spring beam members placeable on a rigid support surface, each of said spring beam members being yieldable and elastic in a direction substantially perpendicular to their longitudinal dimension;

a plurality of transverse lath members for receiving the reclining body, each of said lath members resting on and being supported at the ends of said lath members by said spring beam members without the lath members and spring beam members being fixedly attached therebetween, said lath members being movable vertically without significant flexing in response to the weight of said body as said spring beam members yield elastically; and a flexible support sheet extending generally between opposite ends of said lath members and engaging said spring beam members and holding said spring and lath members together in a resiliently responsive, stable assembly, said support sheet having means for removably attaching said sheet to said opposite ends of said lath members.

2. A structure according to claim 1 wherein said means for removably attaching said sheet to said opposite ends of said lath members includes pockets formed along opposite edges of said sheet to receive the ends of said lath members.

3. A structure according to claim 2 wherein said support sheet passes from the pockets at one ends of said lath members underneath and against said spring beam members to the pockets at the other ends of said lath members.

4. A structure according to claim 3 and further comprising a second flexible sheet extending across upper surfaces of said lath members, said second sheet being detachably connected to said support sheet.

5. A structure according to claim 4 and further comprising means defining flexible tubes for receiving said spring beam members, said means defining said tubes being substantially permanently attached to said support sheet.

6. A structure according to claim 5 wherein each of said spring beam members is divided along its length into a plurality of end-to-end zones each having a selected support hardness different from the other zones, the zone at a head-supporting portion of the structure having the stiffest support hardness.

7. A structure according to claim 6 wherein each of said spring beam members is made from elastic foam and has a cross-section in the shape of a regular polygon.

8. A structure according to claim 6 wherein each of said spring beam members is made from elastic foam and has a cross-section in the shape of a rectangle.

9. A structure according to claim 6 wherein each of said spring beam members is made from elastic foam and has a cross-section in the shape of a circle.

10. A structure according to claim 6 wherein each of said spring beam members is made from elastic foam and has a cross-section in the shape of a hollow tubular member.

11. A structure according to claim 1 and including loops means for interconnecting said ends of said lath members and said spring beam members.

12. A structure according to claim 1 wherein said spring beam members are inflatable.

* * * * *